US007721479B2

(12) United States Patent
Schulst

(10) Patent No.: US 7,721,479 B2
(45) Date of Patent: May 25, 2010

(54) SIGHT FOR A HANDHELD WEAPON

(76) Inventor: Michael Henry Schulst, 8 Jackson Place, Forestdene, Pinetown (ZA) 3610

( * ) Notice: Subject to any disclaimer, the term of this patent is extended or adjusted under 35 U.S.C. 154(b) by 0 days.

(21) Appl. No.: 11/912,297

(22) PCT Filed: Apr. 18, 2006

(86) PCT No.: PCT/IB2006/000893

§ 371 (c)(1),
(2), (4) Date: Oct. 22, 2007

(87) PCT Pub. No.: WO2006/111813

PCT Pub. Date: Oct. 26, 2006

(65) Prior Publication Data

US 2008/0184609 A1 Aug. 7, 2008

(30) Foreign Application Priority Data

Apr. 22, 2005 (ZA) ..... 2005/03291

(51) Int. Cl.
*F41G 1/08* (2006.01)
*F41G 1/42* (2006.01)

(52) U.S. Cl. ..... 42/111; 42/140

(58) Field of Classification Search ..... 42/111, 42/119, 129, 140, 141, 142, 144
See application file for complete search history.

(56) References Cited

U.S. PATENT DOCUMENTS 912,050 A * 2/1909 Wanee ..... 42/144
1,774,053 A * 8/1930 Foster ..... 42/140
2,437,363 A * 3/1948 Smith ..... 42/140
2,968,099 A * 1/1961 Peters, Jr. ..... 42/129
3,481,658 A * 12/1969 Dietrich et al. ..... 359/428
4,616,421 A * 10/1986 Forsen ..... 42/130
4,850,113 A * 7/1989 Doll ..... 42/130
4,926,560 A * 5/1990 Kilgore et al. ..... 42/129
5,519,941 A 5/1996 Yusko (Continued)

FOREIGN PATENT DOCUMENTS

EP 294750 A 12/1988

(Continued)

OTHER PUBLICATIONS

Partial International Search Report of PCT/IB2006/000893 dated Aug. 22, 2006.

*Primary Examiner*—Bret Hayes
(74) *Attorney, Agent, or Firm*—Senniger Powers LLP

(57) ABSTRACT

A rear sight for a handheld weapon. The rear sight includes a tubular device that includes a tubular member comprising a material capable of transmitting visible light so that a target may be viewed through the tubular member, the tubular device, when mounted on a weapon, having at least two circle-like images at different locations along the length thereof that are visible when aiming the weapon on which the sight is mounted at a target by viewing the target through the tubular member. When aiming the weapon, a user will look through the tubular member towards the target and for proper alignment with respect to the target, will maneuver the weapon until the circle-like images are concentrically disposed. This constitutes a simple operation that can be quickly performed, particularly also in low light conditions.

19 Claims, 1 Drawing Sheet

U.S. PATENT DOCUMENTS

| | | | | |
|---|---|---|---|---|
| 5,867,915 | A * | 2/1999 | McMillan | 42/123 |
| 5,956,854 | A | 9/1999 | Lorocco | |
| 6,604,315 | B1 | 8/2003 | Smith et al. | |
| 2002/0056220 | A1 | 5/2002 | Hoadley | |

FOREIGN PATENT DOCUMENTS

| | | | |
|---|---|---|---|
| WO | 98/48237 | A1 | 10/1998 |

* cited by examiner

SIGHT FOR A HANDHELD WEAPON

BACKGROUND

This invention relates to a sight for a handheld weapon, and more particularly to a rear sight for a handheld weapon.

In practice, a rear sight is used in combination with a front sight that is located near the front end of the barrel of a weapon and that includes a reticule (e.g., cross hairs), the rear sight being operatively located on the weapon between the front sight and the position of a person's eye when aiming the weapon at a target. Insofar as it is contemplated that the rear sight can also be independently used as a sight on certain specific weapons, any reference hereinafter to a rear sight must be interpreted accordingly.

SUMMARY OF THE INVENTION

According to the invention there is provided a rear sight for a handheld weapon which includes, in operation when mounted on a weapon, a tubular device including a tubular member comprising a material capable of transmitting visible light so that a target may be viewed through the tubular member, the tubular device having at least two circle-like images at different locations along the length thereof that are visible when aiming the weapon on which the rear sight is mounted at a target by viewing the target through the tubular member.

BRIEF DESCRIPTION OF THE FIGURES

Further features of the rear sight of the invention are described hereinafter with reference to an example of a rear sight for a weapon, which is illustrated in the accompanying diagrammatic drawings. In the drawings.

DETAILED DESCRIPTION

Figure 1:
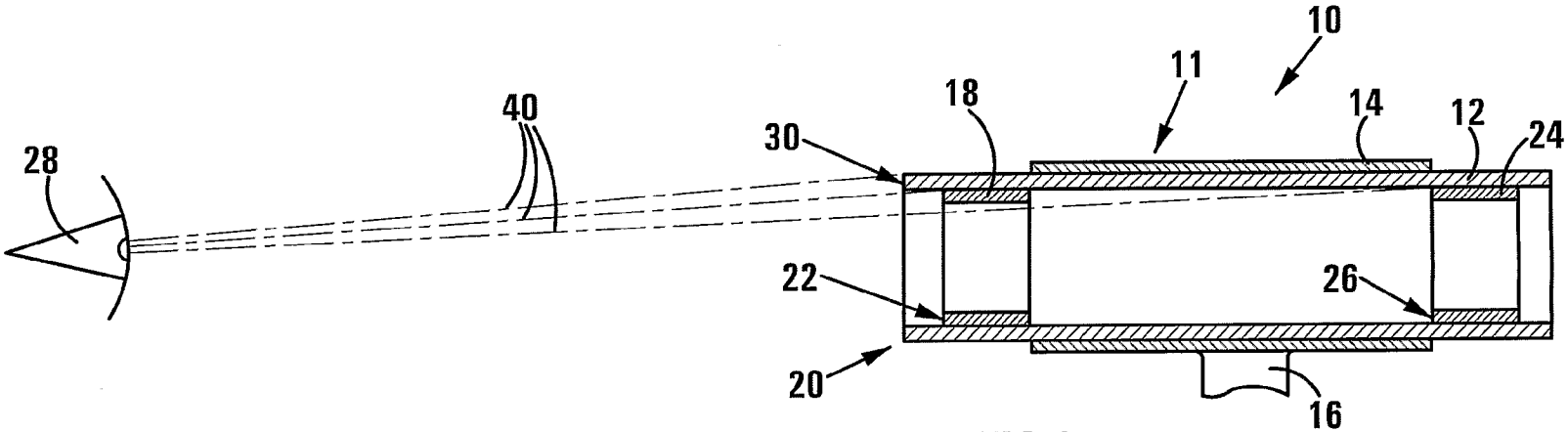
FIG. 1 shows a cross-sectional side view of a rear sight for a weapon, in accordance with the invention.

Referring to the drawings, a rear sight for a weapon forming in combination with a front sight, a part of a weapon sight in accordance with the invention, is designated generally by the reference numeral 10. The front sight of the weapon sight of which the rear sight also forms a part will in practice be located near the front end of an associated weapon, while the rear sight 10 will be located on the weapon in a location between the front sight and the position of a person's aiming eye when aiming the weapon at a target, this location being adjustable in order to accommodate different requirements as will be explained in more detail hereafter.

The rear sight 10 includes a tubular device 11 which includes a tubular member 12 formed of a material through which visible light may be viewed, e.g. of a polycarbonate or of a nylon material. The tubular member may, preferably, be partially encased within a metal housing 14 for protection, but be so constructed as to permit absorption of light through the tubular member for the purpose described hereafter. The metal housing includes a mount 16 whereby the rear sight 10 can be mounted on a weapon, the configuration of the mount being greatly variable and permitting adjustment of the exact positioning of the rear sight with respect to the position of a person's aiming eye when aiming the firearm at a target.

The tubular device 11 also includes a first sleeve forming element 18 which is located on the inner periphery within the tubular member 12 in a spaced location from the front end 20 of the tubular member 12, the element 18 being formed of a material through which visible light may be transmitted and particularly of a material as manufactured by Bayer under the trade name LISA. This material absorbs light through the outer surfaces thereof and transmits the light in a concentrated mode from the edges thereof, the edge 22 of the element thus forming a bright circle-like image within the tubular member 12.

The tubular device 11 also includes a second sleeve-forming element 24 which is formed of the same material of which the element 18 is formed and which thus forming an edge 26 that creates a bright circle-like image, also within the tubular member 12. The two elements, 18 and 24, are of different colors, e.g. red and green, the circle-like images formed thereby thus being of clearly contrasting colors to render them easily visible for the purpose described hereafter. It is particularly contemplated in the above regard that the configuration and location of the housing will be such that the transmission of light is such that the circle-like images are bright and suitably contrasted, to render them readily visible within the tubular member 12 when looking through the tubular member 12 from the location indicated by the eye 28, as shown.

Figure 2:
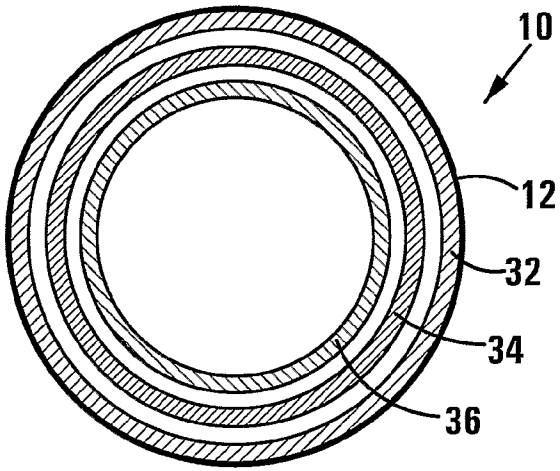
FIG. 2 shows, on an enlarged scale, a front view of the rear sight of FIG. 1.

It will be understood in the above regard that in addition to the circle-like images formed by the elements, 18 and 24, the front face 30 of the tubular member also forms a circle-like image, FIG. 2 identifying the circle-like image formed by the tubular member 12 by the numeral 32, the circle-like image formed by the element 18 by the numeral 34 and the circle-like image formed by the element 24 by the numeral 36. In use, the person aiming the weapon must position his eye at a spaced location from the front face 30 of the tubular device 11 and then maneuver the weapon until the alignment of the tubular member with respect to his eye is such that all three circle-like images, 32, 34 and 36, are concentrically disposed as shown in FIG. 2, thus providing essentially for required alignment of his eye with respect to the rear sight. With his eye so aligned, the front sight of the weapon will be clearly visible within the inner circle-like image 36, it being contemplated that the front sight also may comprise a tubular device which has a circle-like image that will then be concentrically positioned with respect to the inner circle-like image 36. The reticule of the front sight then merely has to be positioned on the target, at which time the weapon will be precisely aimed at the target. It is submitted that the maneuvering of the weapon with respect to a person's eye in order to provide for the proper alignment of his eye with respect to the sight will be an extremely quick and accurate operation, insofar as the bright circle-like images referred to will be clearly visible and easily maneuverable into their required concentric configuration. Once this configuration is achieved, accuracy while aiming at a target is further enhanced by merely positioning the reticule of a front sight on the target, at which time the weapon can be discharged.

It must be understood that within the principles of the rear sight as above described, the exact configuration of the rear sight is variable, particularly in relation to the circle-like images. In this regard it is contemplated, for example, that the rear end of the tubular member of the rear sight also can serve to define a circle-like image, whereas more than two sleeve-like elements also can be located within the tubular member. The tubular member also may taper from the front end thereof to the rear end thereof.

It is also contemplated that the actual position of the second sleeve forming element 24 is variable in order to accommodate different spacings of the rear sight with respect to a person's eye, for example, where a person's eye is positioned nearer the front end of the rear sight 10, the spacing between the two elements, 18 and 24, should be reduced (see the sight lines 40 from a person's eye 28 to the circle-like images as shown in FIG. 1).

The rear sight may be formed of various different materials. The invention extends also individually to a front sight and a rear sight that can together form a sight for a weapon, as well as to a sight equivalent to the rear sight which can in itself serve the purpose of a weapon sight, i.e. without a front sight, in relation to a particular weapon. The dimensions of the rear sight of the invention are greatly variable and are determined in practice by the specific requirements in relation to the weapon with respect to which the sight is to be utilized.

In use of the rear sight of the invention, when aiming the associated weapon on which it is mounted at a target, the aiming eye of the user will look through the rear sight toward the target and for proper alignment with respect to the target, will maneuver the weapon until the two or more circle-like images are concentrically disposed. It is contemplated that the above mode of aiming will be extremely quick, maneuvering the weapon for positioning the two or more circle-like images concentrically with respect to one another, in practice, being a very simple operation to perform.

The length and diameter of the tubular member, in relation to the use of the rear sight on a particular weapon, is determined such that the circle-like images are clearly visible and easily positionable in a concentric configuration with respect to one another when aiming the weapon at a target by viewing through the tubular member. The above parameters will be determined in practice by the particular requirements of the weapon on which the rear sight is to be mounted, taking into account requirements regarding speed of sight acquisition, accuracy, and the like, and the location of the rear sight on the weapon with respect to the ordinary position of a person's eye when aiming the weapon, particularly also in adverse conditions of duress and/or in low light conditions.

The tubular member of the tubular device of the rear sight may have a constant diameter along the length thereof, i.e. may be cylindrical. It will be understood that this cylindrical configuration of the tubular member, for a particular operative position of the rear sight on a weapon, will cause the tubular member to appear to taper from the front end of the member to the rear end of the member. The tubular member also may taper from the front end thereof to the rear end thereof.

The circle-like images formed by the tubular device may be formed by the tubular member itself and, as such, may be formed on the front face of the tubular member and on the rear end of the tubular member. In order to enhance the clarity of these circle-like images, an opaque coating may be applied to the front face of the tubular member and within the tubular member at the rear end thereof.

Still further according to the invention, at least one circle-like image may be formed by a sleeve forming element located in the tubular member at a location along the length thereof. The sleeve forming element located in the tubular member may form a circular face projecting from the inner surface of the tubular member, forming the circle-like image formed by the sleeve forming element.

The tubular member also may have at least two sleeve forming elements located therein at different locations along the length thereof, each forming a circle-like image. As such, one sleeve forming element may be located near the front end of the tubular member and a second sleeve forming element may be located near the rear end of the tubular member.

Each sleeve forming element as above contemplated may be formed of a translucent material which, through absorption of light through the translucent tubular member of the tubular device, provides for the edge thereof that forms a circle-like image to emit concentrated light, sharply defining and rendering the circle-like image clearly visible. The sleeve forming elements may thus be of contrasting colors, e.g. red and green. Where a sleeve forming element is formed of a see-through material as envisaged, a particularly suitable material that is known in the trade and that is considered suitable for the purpose is a material manufactured by Bayer under the trade name LISA or a material manufactured by A.E.C.I. under the trade name LUCITE, although any other suitable material can be utilized also for the purpose.

It must be understood that where two sleeve forming elements are located within the tubular member, positioning of the circle-like images formed thereby in a concentric configuration may in itself provide for aiming of the associated weapon, or both the circle-like images also may be concentrically positioned with respect to any other circle-like image formed by the tubular device for aiming of the associated weapon.

It must be understood still further that the dimensions of the sleeve forming elements and particularly the thickness of these elements may be variable, with the particular objective being to form clearly contrasting bright and sharp circle-like images that will enhance aiming of an associated weapon at a target, with particular emphasis on speed and accuracy, particularly in conditions of low light.

It is contemplated also that the spacing between the circle-like images that are formed by the sleeve forming elements may be rendered variable in order to accommodate an individual person's requirements, it being particularly contemplated that the position of either one or both sleeve forming elements located within the tubular member of the tubular device may be adjustable. The tubular member of the tubular device of the rear sight of the invention may be formed of any suitable see-through material, the device typically being formed of any one of a polypropylene material, nylon, perspex, glass, and the like. The tubular member also may be partially encased in a metallic housing for protection. As such, the housing may incorporate mounting means for mounting the tubular device on a weapon. The mounting means optionally may permit adjustable mounting of the tubular device on a weapon.

Where the rear sight of the invention is used in combination with a front sight on a weapon, the front sight also may comprise a tubular device of a see-through material and optionally also may have a sleeve forming element located therein that will provide for it to define a bright and sharply defined circle-like image to contrast with the circle-like images formed by the rear sight, hence to facilitate aiming of the associated weapon by positioning the reticule of the front sight on the target. The invention extends also to a sighting system for a weapon which includes a rear sight, in accordance with the invention, and a front sight to be mounted on a weapon near the front end thereof.

The invention claimed is:

1. A rear sight for a hand held weapon comprising a tubular device including a tubular member made of a light-transmitting material, the tubular device having at least two annular images at different locations along the length thereof that are illuminated by light transmitted through the light-transmitting material of the tubular member and visible when aiming the weapon at a target by viewing the target through the tubular member.

2. A rear sight as claimed in claim 1, wherein the tubular member has a length and a diameter which are sized such that the annular images are clearly visible and easily positionable in a concentric configuration with respect to one another when aiming the weapon at a target by viewing the target through the tubular member.

3. A rear sight as claimed in claim 1 wherein the tubular member has a constant diameter along the length thereof.

4. A rear sight as claimed in claim 1, wherein the annular images are formed by the tubular member itself.

5. A rear sight as claimed in claim 4, wherein the annular images formed by the tubular member itself are formed on a front face of the tubular member and on a rear end of the tubular member.

6. A rear sight as claimed in claim 5, wherein an opaque coating is applied to the front face of the tubular member and within the tubular member at the rear end thereof, to form the annular images.

7. A rear sight as claimed in claim 1, further comprising a sleeve forming element located within the tubular member at a location along the length thereof, the sleeve forming element comprising at least one of the annular images.

8. A rear sight as claimed in claim 7, wherein the sleeve forming element located in the tubular member has a circular face projecting from an inner surface of the tubular member, and wherein the circular face forms the annular image.

9. A rear sight as claimed in claim 8, wherein the tubular member has at least two sleeve forming elements located therein at different locations along the length thereof and wherein each sleeve forming element forms an annular image.

10. A rear sight as claimed in claim 9, wherein a first sleeve forming element is located near a front end of the tubular member and a second sleeve forming element is located near a rear end of the tubular member.

11. A rear sight as claimed in claim 9, wherein an edge of each sleeve forming element comprises one of said annular images, and wherein the sleeve forming elements are formed of a light-transmitting material that absorbs light through the tubular member and emits the light at said edges to illuminate the annular images.

12. A rear sight as claimed in claim 11 wherein the sleeve forming elements are of contrasting colors.

13. A rear sight as claimed in claim 9 wherein the spacing between the annular images formed by the sleeve forming elements is variable through adjustment of the location of either sleeve forming element in the tubular member.

14. A rear sight as claimed in claim 7, wherein an edge of the sleeve forming element comprises one of said annular images, and wherein the sleeve forming element is formed of a material that absorbs light through the tubular member and emits the light at said edge to illuminate the annular image.

15. A rear sight as claimed in claim 1, wherein the tubular device includes a metallic housing that partially encases the tubular member.

16. A rear sight as claimed in claim 15, wherein the housing includes a mount for mounting the tubular device on a weapon.

17. A rear sight as claimed in claim 16, wherein the mount permits adjustable mounting of the tubular device on a weapon.

18. A rear sight for a hand held weapon comprising a tubular device including a tubular member having a side wall, the side wall comprising a light-transmitting material, the tubular device having at least two annular images at different locations along the length thereof that are illuminated by light transmitted through the light-transmitting material of the side wall and visible when aiming the weapon at a target by viewing the target through the tubular member.

19. A rear sight for a hand held weapon comprising a tubular device including a tubular member having a side wall, the side wall being made of a light-transmitting material, the tubular device having at least two annular images at different locations along the length thereof that are illuminated by light transmitted through the light-transmitting material of the side wall and visible when aiming the weapon at a target by viewing the target through the tubular member.

* * * * *